US010938138B2

(12) United States Patent
Lehmann et al.

(10) Patent No.: US 10,938,138 B2
(45) Date of Patent: Mar. 2, 2021

(54) ELECTRICAL CONTACT TERMINAL FOR AN ELECTRICAL PLUG CONNECTOR FOR A SAFETY RESTRAINT SYSTEM

(71) Applicant: APTIV TECHNOLOGIES LIMITED, St. Michael (BB)

(72) Inventors: Rene Lehmann, Furth (DE); Peter Nuetzel, Oberasbach (DE)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/850,566

(22) Filed: Apr. 16, 2020

(65) Prior Publication Data

US 2020/0350719 A1 Nov. 5, 2020

(30) Foreign Application Priority Data

Apr. 30, 2019 (EP) ..... 19171858

(51) Int. Cl.
*H01R 13/11* (2006.01)
*H01R 13/03* (2006.01)
(Continued)

(52) U.S. Cl.
CPC ..... *H01R 13/112* (2013.01); *H01R 13/03* (2013.01); *H01R 13/405* (2013.01);
(Continued)

(58) Field of Classification Search
CPC ..... H01R 13/64; H01R 13/03; H01R 43/18; H01R 13/633
See application file for complete search history.

(56) References Cited

U.S. PATENT DOCUMENTS 5,591,041 A * 1/1997 Cecil, Jr. ..... H01R 13/639 439/352
6,893,277 B2 * 5/2005 Parrish ..... H01R 13/506 439/188

(Continued)

FOREIGN PATENT DOCUMENTS

DE 10 2017 109246 A1 10/2018
EP 3 116 075 A1 1/2017

OTHER PUBLICATIONS

Extended European Search Report for Application No. EP 19 17 1858 dated Sep. 10, 2019.

*Primary Examiner* — Abdullah A Riyami
*Assistant Examiner* — Nader J Alhawamdeh
(74) *Attorney, Agent, or Firm* — Carlson, Gaskey & Olds, P.C.

(57) ABSTRACT

An electrical contact terminal for an electrical plug connector for a safety restraint system is made from a single piece of bent and cut sheet-metal. The electrical contact terminal includes a mating end, having at least one contact face adapted for electrically contacting a corresponding counter contact of a counter connector. The mating end defines a mating direction of the electrical contact terminal. The electrical contact terminal includes a mounting end, having a mounting face adapted for being electrically connected to a cable end of an electrical cable. The mounting end defines a cable extension direction of the electrical contact terminal. The electrical contact terminal includes a shorting clip portion and an anchor leg, including a first abutment face. The first abutment face is a cut face of the sheet metal a surface normal of the first abutment face faces in the cable extension direction.

13 Claims, 6 Drawing Sheets

(51) Int. Cl.

| | |
|---|---|
| ***H01R 13/405*** | (2006.01) |
| ***H01R 13/629*** | (2006.01) |
| ***H01R 13/64*** | (2006.01) |
| ***H01R 43/16*** | (2006.01) |

(52) U.S. Cl.
CPC ..... *H01R 13/629* (2013.01); *H01R 13/64* (2013.01); *H01R 43/16* (2013.01); *H01R 2201/26* (2013.01)

(56) References Cited

U.S. PATENT DOCUMENTS

| | | | | |
|---|---|---|---|---|
| 8,545,262 | B2 * | 10/2013 | Schmidt | H01R 13/7032 439/507 |
| 9,054,457 | B2 * | 6/2015 | Odorfer | F42B 3/26 |
| 2002/0081888 | A1 * | 6/2002 | Regnier | H01R 13/639 439/352 |
| 2002/0115336 | A1 * | 8/2002 | Gunreben | H01R 13/5829 439/468 |
| 2004/0248454 | A1 * | 12/2004 | Gunreben | H01R 13/639 439/352 |
| 2007/0105442 | A1 * | 5/2007 | Gunreben | H01R 13/506 439/607.01 |
| 2012/0112762 | A1 * | 5/2012 | Odorfer | H01R 13/7033 324/538 |
| 2013/0252455 | A1 * | 9/2013 | Gunreben | H01R 4/48 439/370 |
| 2014/0045361 | A1 * | 2/2014 | Gunreben | H01R 13/6275 439/345 |
| 2014/0287611 | A1 * | 9/2014 | Gunreben | H01R 13/641 439/354 |
| 2017/0012392 | A1 * | 1/2017 | Kot | H01R 13/03 |

* cited by examiner

ELECTRICAL CONTACT TERMINAL FOR AN ELECTRICAL PLUG CONNECTOR FOR A SAFETY RESTRAINT SYSTEM

CROSS REFERENCE TO RELATED APPLICATION

This application claims priority to European Patent Application No. 19171858.4, filed on Apr. 30, 2019.

TECHNICAL FIELD

The subject matter of this disclosure relates to an electrical contact terminal for an electrical plug connector for a safety restraint system, such as an airbag ignition system, and to an electrical plug connector. An electrical plug connector comprising at least two of said electrical contact terminals allows electrically or electronically monitoring the correct coupling of the plug connector with a suitable counter connector.

TECHNICAL BACKGROUND

Passenger cars have nowadays a number of safety restraint systems, such as seat belts pretensions or airbags, as e.g. front and side airbags, which serve to cushion or limit the impact of a passenger with for example interior parts of passenger cars in case of an accident. Deceleration sensors in the passenger vehicle detect high deceleration values as they occur in case of an accident and send a trigger signal via wire or cable to the safety restraints system. An explosive device, known as squib, inflates the airbag or tightens the belt. The wires or cables of the deceleration sensor are connected to an electronic controlled unit and then to a squib, by means of a so-called squib connector.

To this day, the squib is usually provided with a socket or receptacle which contains two contact pins. The squib connector comprises a plug part or a plug connector corresponding to the socket, which plug part has two electrical contact terminals for the reception of the contact pins of the squib socket. To improve the connection between the squib and the plug connector, retainer inserts were developed, which are adapted to fit into the receptacle of standardized squibs and which facilitate and secure the connection between the squib and the plug connector. Alternatively to the use of retainers, secondary locking member, also called connector position assurance members, better known as CPA members, were developed, that are mated with the plug connector after the plug connector is coupled to a corresponding counter connector. Such a CPA member is designed, so that a mating to the plug connector is only possible, if the plug connector is correctly coupled to the corresponding counter connector, i.e. the CPA member cannot be mated to the plug connector, if the plug connector is in an uncoupled or incorrectly coupled condition.

Typically, the plug connector, or respectively the electrical contact terminals of the plug connector, are further provided with a so-called shorting clip, which is usually an electro conductive metallic spring part, formed by respective shorting clip portions of the electrical contact terminals. The shorting clip short-circuits the electrical contact terminals of the plug connector. The short-circuiting of the electrical contact terminals may serve to prevent an unintended explosion of the pyrotechnic charge due to electrical potential differences occurring between the electrical contact terminals, for example during mating of the plug connector. The shorting circuit established by the shorting clip is separated and opens upon correct coupling of the plug connector with the corresponding plug connector. Alternatively, the shorting clip can be opened by a CPA member. Upon correct coupling of the plug connector with its counterpart, the short circuit between the electrical contact terminals is automatically opened. This can be detected by means of suitable electrical/electronic monitoring means, as it is well known to the skilled person. Thus, the shorting clip alternatively or additionally serves to electrically and/or electronically monitoring the correct coupling of the plug connector with its counterpart.

Document WO 2010/143 078 discloses a squib connector that allows the electrical monitoring of the correct coupling of the connector. Therefore, the terminals of the connector are in electrical contact with each other in the uncoupled or incorrectly coupled condition of the plug connector. This electrical contact between the terminals is adapted for being separated upon correct coupling to a corresponding counter connector either automatically, i.e. by a retainer or by an actuating action, such as a mating a CPA member. Thus, disconnecting of the terminals can be monitored by a suitable monitoring means.

A reliable monitoring requires a reliable short-circuiting of the shorting clip. This shorting clip and in particular shorting clip portions of the electrical contact terminals may, however, be damaged or displaced during handling or plugging of the electrical plug connector. This is, as the terminals are connected with electrical cables, e.g. of a cable harness. Thus, during manufacturing transport or further processing, such as installation of the plug connector within a passenger car, overly high retention forces at the cable may damage or displace the terminal and/or the shorting clip portions. This damage or displacement may not be invisible from the outside but nevertheless may result in an opening the shorting clip. Thus, neither the ignition prevention can be provided nor can be monitored, whether the electrical plug connector is properly coupled to the counterpart. This is undesirable.

There is a need in the art for providing electrical contact terminals and respective plug connectors that can withstand increased retention forces of the cables. Further, it is desirable that the electrical contact terminal is not or at least less deformed and/or displaced upon a pulling force on the cable. In case the retention force exceeds the allowable retention force, however, a possible defect of the plug connector shall be visible from the outside of the housing of the plug connector. Thus, deformation, displacement or breaking of the electrical terminal shall be prevented. Instead a connection between the electrical contact terminal and the cable shall be broken in case of exceeding allowable retention forces.

Further as the building space in passenger cars is generally limited, it is desirable to reduce the overall size of the electrical plug connector and the electrical contact terminal.

SUMMARY

An illustrative example embodiment of an electrical contact terminal for an electrical plug connector is useful with a safety restraint system, such as a seat belt pretension system or an airbag system. The electrical contact terminal is made from a single piece of bent and cut sheet-metal, thereby allowing for reduced manufacturing costs and good electrical conductivity, as there are no interfaces between the mating end of the electrical contact terminal and a mounting end of the electrical contact terminal.

The electrical contact terminal comprises a mating end, having at least one contact face adapted for electrically contacting a corresponding counter contact of a counter connector. The mating end defines a mating direction of the electrical contact terminal. Further, the mating end may have multiple contact faces, such as two, three or four contact faces, that are arranged around a receiving portion of the electrical contact terminal that is adapted to receive a corresponding counter contact of a counter connector for establishing an electrical contact. The mating direction is the direction for mating an electrical plug connector that comprises the electrical contact terminal. The mating direction faces away from the electrical contact terminal and the electrical plug connector, respectively.

The electrical contact terminal may comprise a mounting end, having a mounting face adapted for being electrically connected to a cable end of an electrical cable. The connection between the cable end and the mounting face may be welded, soldered, crimped or otherwise be established. Particularly welding allows for a good electrical and mechanical connection, while requiring only small contact faces. Thus, welding allows to reduce the length of the mounting end. A mounting end may have a length in the range of about 3.5 mm to 7.5 mm, preferably in the range of 3.8 mm to 6.4 mm and most preferably in the range of 4.1 mm to 4.5 mm, and in particular of about 4.3 mm. Further, the mounting end defines a cable extension direction of the electrical contact terminal, wherein the cable extension direction faces away from the electrical contact terminal and the electrical plug connector, respectively.

The cable extension direction and the mating direction may be parallel to each other, resulting in a straight electrical plug connector. Alternatively, the cable extension direction and the mating direction may be angled, resulting in an angled electrical plug connector. For example, the cable extension direction and the mating direction may enclose an angle in the range of 70 to 120 degrees, preferably in the range of 80 to 110 degrees and most preferably of about 90 degrees. An angled electrical plug connector allows for a facilitated provision of a secondary locking member (such as a CPA), as the backside of the electrical plug connector is not blocked by extending cables. Thus, the backside of the electrical plug connector can be provided with the secondary locking member. Providing a secondary locking member at a backside of the electrical plug connector allows to actuate (mate) the secondary locking member in mating direction. Thus, a single mating movement of the plug connector can first couple the electrical plug connector with its counterpart and secondly lock the secondary locking member, thereby opening the shorting clip.

The electrical contact terminal may comprise a shorting clip portion that is adapted to short-circuit the electrical contact terminal with a further electrical contact terminal, if the electrical contact terminal is provided in an electrical plug connector and if the electrical plug connector is in an uncoupled or incorrectly coupled condition. The shorting clip portion may serve to electrically and/or electronically monitor the correct coupling of the plug connector with its counterpart and/or to prevent an unintended explosion of a pyrotechnic charge of the safety restraint system, due to electrical potential differences occurring between the electrical contact terminals, for example during mating of the plug connector.

The shorting clip portion may comprise a flexible arm having on a distal end portion a shorting face. In an electrical plug connector comprising at least two electrical contact terminals, the shorting clip portions of the respective electrical contact terminals form a shorting clip. In an uncoupled or incorrectly coupled condition, the flexible arm of the respective electrical contact terminal serves for pressing the shorting face against a shorting face of a corresponding electrical contact terminal, thereby short-circuiting the electrical contact terminals with each other. The elastic force of the flexible arm allows to maintain the short-circuiting, e.g. during vibration and shock. For opening the shorting clip one or both flexible arms of the respective electrical contact terminals may be deflected, thereby separating the contact of the shorting faces.

The electrical contact terminal may comprise an anchor leg that includes a first abutment face, wherein the first abutment face is a cut face of the sheet metal, and wherein a surface normal of the first abutment face faces in cable extension direction. The anchor leg may be separate from the flexible arm and may be designed to be stiffer.

The abutment face serves to abut a contrary abutment face provided in a housing of the electrical plug connector. Further, as the first abutment face is a cut face, the abutment face can be very precisely manufactured compared e.g. to a bended abutment face. Thereby, the electrical contact terminal can be positioned very precisely within a housing of the electrical plug connector and accordingly, the position of the meeting end and the shorting clip can be determined very exactly in cable extension direction. Further, as the first abutment face faces in cable extension direction and abuts the first contrary abutment face, the allowable retention force can be increased. The allowable retention force defines the maximal pulling force at the cable, that will not result in a plastic deformation, displacement or breakage of the terminal and/or a cable rip-off.

Still further, with providing a separate anchor leg that is separate from the flexible arm, the position of the shorting clip portion is less affected, if there is a pulling force on the cable. The anchor leg has a main plane that corresponds to the sheet plane of the preform metal sheet. The main plane of the anchor leg may be parallel to the mating direction A and at the same time parallel to the cable extension direction. Thereby, the cut and/or punch design of the anchor leg can be designed to provide a high second moment of area and thereby, deformation of the anchor leg due to a pulling force in cable extension direction can be reduced.

In particular, the design of the anchor leg can be chosen so that a pulling force on the cable will lead to a rupture of the cable or a cable rip-off first, before the electrical contact terminal is displaced, plastically deformed or even breaks. Thus, in case of damage, the damage will occur at the cable or at the connection portion between the cable and the mounting end. This damage will then be visible from the outside of the housing. Thus, damages due to exceeding retention forces at the cable can be seen and the risk of assembly damaged electrical plug connectors in passenger cars or vehicles can be reduced.

The anchor leg may further include a first bearing face, wherein the first bearing face may be a cut face of the sheet metal, and wherein a surface normal of the first bearing face faces in the mating direction. By providing a first bearing face that is a cut face and that faces in the mating direction, the electrical contact terminal and in particular the shorting clip portion can be positioned very precisely in the mating direction. This allows for a more reliable contacting of the counter connector as well as for a more reliable short-circuiting of the respective electrical contact terminals.

Further, the anchor leg may extend in the mating direction and the anchor leg may further include an anchor protrusion extending in cable extension direction, wherein the first abutment face and/or the first bearing face are provided on the anchor protrusion. With providing an anchor protrusion extending in cable extension direction, the second moment of area of the anchor leg can be further increased. Thereby, a plastic deformation resulting from a pulling force at the cables can be minimized. Thus, a more reliable electrical contact terminal and a more reliable electrical plug connector can be provided.

The anchor leg may comprise at least one stiffening element, wherein the stiffening element may be an embossed element. With providing at least one stiffening element, the anchor leg is less prone to plastic deformation and therefore allowable retention force can be further increased. The stiffening element(s) may be embossed elements, that are embossed in the anchor leg. In case of multiple stiffening elements, the elements may be embossed in the anchor leg from different sides of the main plane of the anchor leg. Thus, the overall stiffness of the anchor leg can be further increased.

The electrical contact terminal may further comprise a fixing plate part, including a second abutment face, wherein the second abutment face is a main face of the sheet metal and wherein a surface normal of the second abutment face faces in cable extension direction. Providing a second abutment face further increases the allowable retention force and reduces the likelihood of an undesired plastic deformation or displacement of the electrical contact terminal.

In particular, the second abutment face may be arranged in close proximity to the mounting end of the electrical contact terminal. There may be only a single bent portion between the mounting end and the fixing plate part including the second abutment face. Thereby a pulling force applied on a cable connected to the mounting end of the electrical contact terminal can be directly transmitted to the housing and/or a cover of the plug connector and thereby, displacement and plastic deformation of the electrical contact terminal can be further reduced, resulting in an increased allowable retention force. The second abutment face may be adapted to abut with a contrary abutment face of a housing or a cover of the electrical plug connector if the electrical contact terminal is received within respective electrical plug connector, as will be described in greater detail hereinafter.

The fixing plate part may include a test contact portion. The test contact portion may be assessable from the outside of the plug connector and thereby may serve for monitoring the correct coupling of an electrical plug connector comprising the electrical contact terminal with its counterpart. Providing the test contact portion at the fixing plate part does not affect the mating end or the shorting clip during monitoring. Thus, damages of these parts can, e.g. due to improper test-contacting, can be reduced.

The electrical contact terminal may further comprise a bearing protrusion, being arranged on a bearing end of the electrical contact terminal, opposite to the mounting end, wherein the bearing protrusion includes a second bearing face. Said second bearing face may be a cut face of the sheet metal. A surface normal of the second bearing face faces in the mating direction. With providing a second bearing face, that is adapted to be supported by respective contrary bearing face of the electrical plug, the electrical contact terminal can be positioned very precisely in the mating direction within the electrical plug connector. Further, with providing a second bearing face on a bearing end of the electrical contact terminal that is opposite to the mounting end, an undesired tilting of the electrical contact terminal within the plug connector can be prevented. Thereby, a reliable short-circuiting of respective electrical contact terminals by a shorting clip can be provided.

Further the mounting end may be a welding end and the mounting face may be adapted for being welded to a cable end of an electrical cable. Thus, a cable end can be welded to the mounting face of the mounting end, thereby providing a good electrical conductivity and a high mechanical strength. The desired mechanical strength of the welding connection can be adjusted e.g. by varying the length of the mounting end and/or the welding area. Thus, the allowable retention force in the cable extension direction of the welded cable can be chosen to be below a threshold, wherein the threshold defines the point, where the electrical contact terminal would start to plastically deform or even break, due to a pulling force applied to the welded cable in cable extension direction. Therefore, damage due to exceeding retention forces that would lead to a undesired deformation or breakage of the electrical contact terminal can be prevented. Rather, the welding connection would break due to said exceeding retention forces and the electrical contact terminal remains undamaged.

Further, the above objects are achieved by an electrical plug connector for a safety restraint system, preferably for an airbag ignition system. The electrical plug connector comprises at least a first and a second electrical contact terminal, having at least some of the features as described above. Further, the electrical plug connector comprises a housing, having a receiving portion that at least partly receives the first and second electrical contact terminals so that a shorting clip portion of the first electrical contact terminal and a shorting clip portion of the second electrical contact terminal form a shorting clip. Said shorting clip short-circuits the electrical contact terminals, if electrical plug connector is in an uncoupled or incorrectly coupled condition. The housing comprises at least one first contrary abutment face and/or at least one first contrary bearing face. The first contrary abutment face abuts at least the first abutment face of one of the electrical contact terminals. The first contrary bearing face may support at least the first bearing face of one the electrical contact terminals.

As described above, providing a first abutment face and a first contrary abutment face, allows for increased allowable retention forces. Further, the electrical contact terminal can be positioned more precisely in the cable extension direction within the electrical plug connector, thereby providing more reliable short-circuiting.

Further, the first abutment face being a cut face of the anchor leg allows for designing the anchor leg to have a high second moment of area and therefore is less prone to plastic deformation due to pulling forces at the cable in the cable extension direction. Further, providing a first bearing face and a first contrary bearing face allows for an exact positioning of the electrical contact terminal within the electrical plug connector in the mating direction.

The housing further comprises at least one second contrary bearing face that supports at least the second bearing face of one of the electrical contact terminals. Proving a second bearing face in the respective second contrary bearing face allows to position the electrical contact terminal within the electrical plug connector precisely in the mating direction. Thereby, the mating end and/or the shorting clip portions can be positioned precisely resulting in a more reliable electrical contact of these parts.

The electrical plug connector may further comprise a cover that is coupled to the housing and covers the receiving portion. The coupling may be achieved with any suitable means and may be reversible, e.g. by means of locking elements, or may be permanent, e.g. due to gluing or welding. The cover includes at least one positioning recess that at least partly receives the fixing plate part of one of the electrical contact terminals. Further, the positioning recess may form a second contrary abutment face that abuts the second abutment face of the electrical contact terminal whose fixing plate part is received in the positioning recess.

Providing a positioning recess allows for an exact positioning of the electrical contact terminal in the cable extension direction. Further, with providing a second abutment face and a respective second contrary abutment face, the allowable retention force can be further increased and the likelihood of an undesired displacement or plastic deformation of the electrical contact terminal or even a breakage of the electrical contact terminal can be reduced.

The cover may further include a clamping protrusion that clamps the mounting end of the received electrical contact terminal with the housing. The clamping protrusion clamps a mounting end of the received electrical contact terminal with the housing up on coupling the cover with the housing (clamping engagement). Thus, there is a mechanical fixation of the mounting end and/or a cable connected to the mounting end in the housing of the electrical plug connector. A pulling force provided at the cable is directly guided into the housing via the clamping engagement. Thus, a plastic deformation of the electrical contact terminal can be effectively be prevented, as the pulling force is directly guided to the housing and is not transmitted via the other parts of the electrical contact terminal.

The electrical plug connector may further comprise a secondary locking member which is insertable into the housing of the electrical plug connector and which upon full insertion into the housing of the plug connector separates the short-circuiting contact between the at least two shorting clip portions that form the shorting clip. Providing a secondary locking member (also referenced as connector position assurance member (CPA)) allows an electrical or electronic monitoring of a correct plugging. This is, as the CPA is only insertable into the housing and therefore only separates the short-circuiting contact (i.e. opens the shorting clip), if the plug connector and the corresponding counter connector are coupled correctly to each other.

The short-circuiting contact between the at least two shorting clip portions that form the shorting clip may be adapted to be separated upon correct coupling of the plug connector to a corresponding counter-connector, due to a mechanical contact with a separator means of the counter-connector. This allows an automated separation of the contact between the shorting clip portions. Therefore, the plugging of the plug connector is facilitated, and no additional parts, such as a CPA member, are necessary. Further, the correct plugging can be monitored electrically or electronically.

The electrical plug connector may comprise no ferrite element. Thus, the overall size of the electrical plug connector can be reduced. The length of the electrical plug connector (in the cable extension direction) may be in the range of 19 mm to 23 mm, preferably in the range of 19.5 mm to 21 mm and most preferably in the range of 20 mm to 20.5 mm.

Further, the above objects are achieved by a method for assembling an electrical plug connector as described above. The method comprises the steps of providing at least two electrical contact terminals; providing a housing; and inserting the electrical contact terminals in a receiving portion of the housing so that a shorting clip portion of the first electrical contact terminal and a shorting clip portion of the second electrical contact terminal form a shorting clip that short-circuits the electrical contact terminals, if electrical plug connector is in an uncoupled or incorrectly coupled condition, and so that a first contrary abutment face of the housing abuts at least the first abutment face of one of the electrical contact terminals.

BRIEF DESCRIPTION OF THE DRAWINGS

In the following, at least one embodiment of the invention is described exemplarily with reference to the enclosed figures, in which.

DETAILED DESCRIPTION

Figure 1:
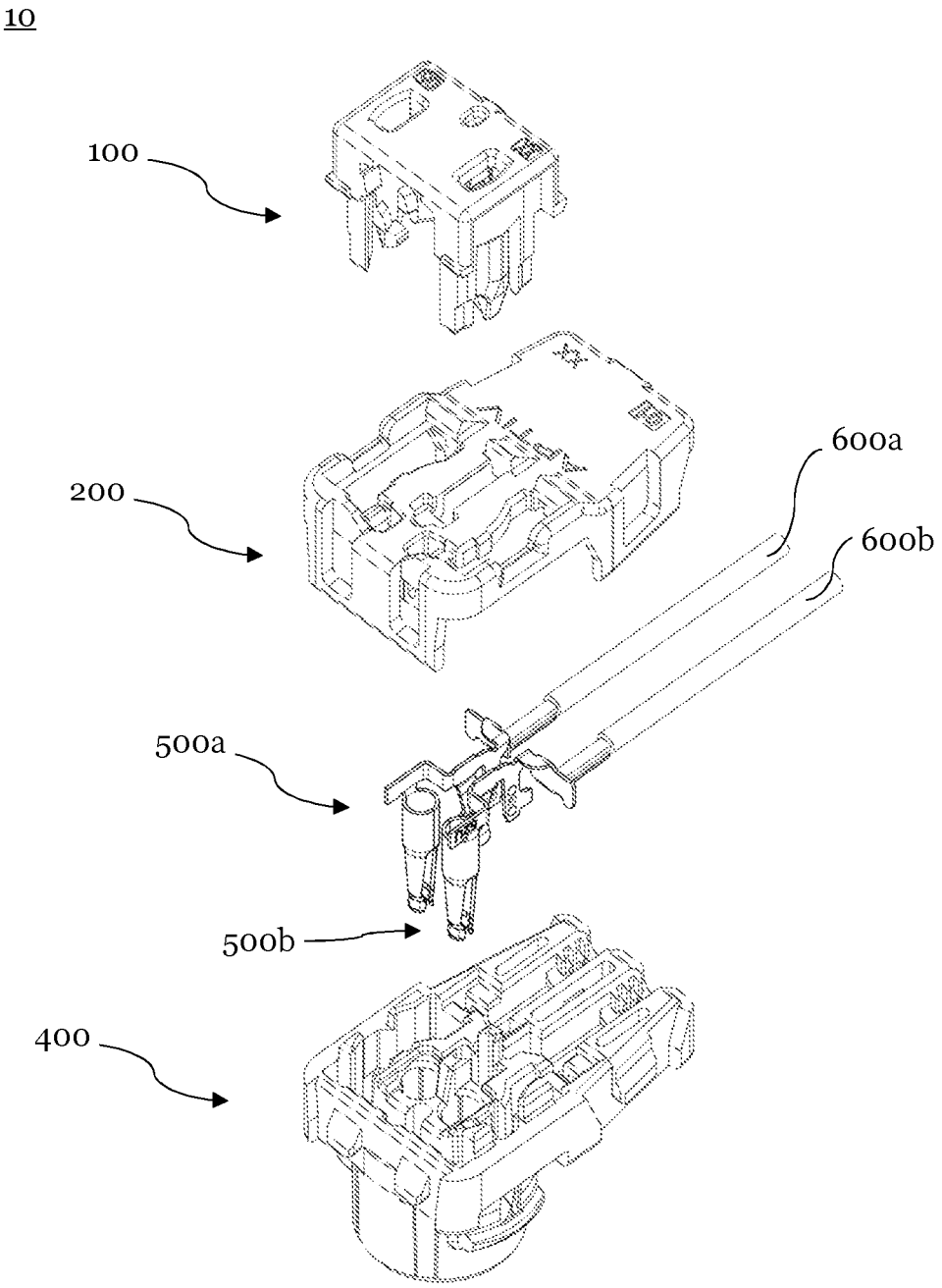
FIG. 1 shows a schematic exploded view of an electrical plug connector.

FIG. 1 shows a schematic exploded view of an electrical connector 10. The plug connector comprises a housing 400. The housing 400 has a receiving portion that is adapted to at least partially receive a first electrical contact terminal 500*a* and a second electrical contact terminal 500*b*. Those terminals 500*a*, 500*b* will be described with greater detail with respect to FIGS. 4 and 5.

The electrical contact terminals 500*a*, 500*b* are electrically connected to cables 600*a*, 600*b*. After being received within the housing, the housing 400 can be covered by a cover 200, wherein the cover 200 is coupled to the housing 400 e.g. by locking means. Alternatively, the housing could be permanently fixed to the cover, e.g. by gluing or welding. Further, the electrical plug connector 10 comprises a secondary locking member 100 (also referenced as connector position assurance member (CPA)). The secondary locking member 100 is insertable into the cover 200 and the housing 400 of the plug connector 10. Upon full insertion into the housing 400 the secondary locking member 100 may separate a short-circuiting contact between the at least two shorting clip portions 530*a*, 530*b* that form the shorting clip 530 (cf. FIG. 3).

Figure 2A:
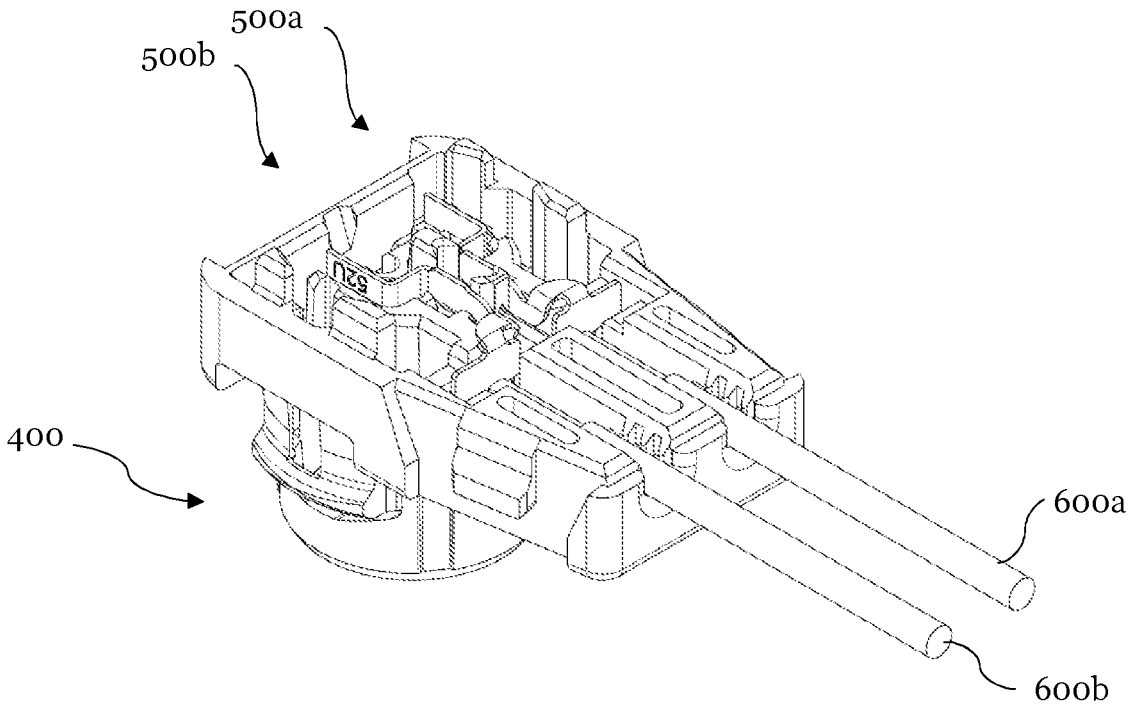
FIG. 2A shows a schematic perspective view of an electrical plug connector, wherein the cover and the CPA are removed.

FIG. 2A shows the housing 400 of the electrical plug connector 10, wherein the electrical contact terminals 500*a*, 500*b* are received within the housing. The respective cable 600*a*, 600*b*, which are coupled to individual ones of the electrical contact terminals 500*a*, 500*b* are received within a cable recess of the housing 400 and extend in cable extension direction C, wherein the cable extension direction C faces away from the housing 400 of the plug connector 10.

Figure 2B:
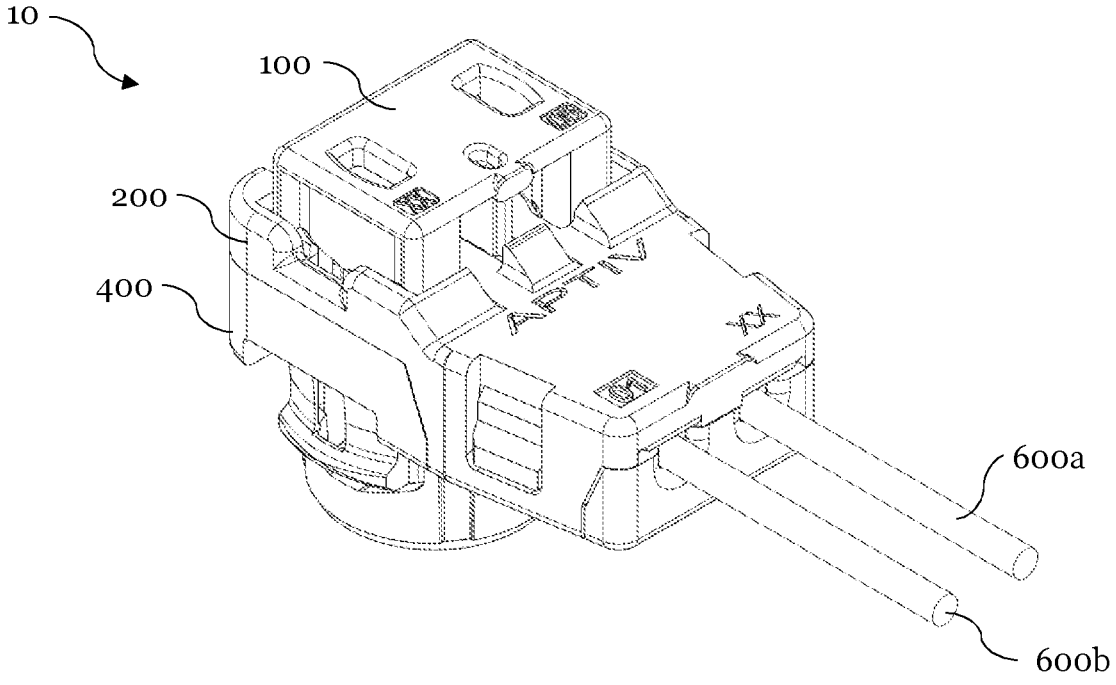
FIG. 2B shows a schematic perspective view of an electrical plug connector.

FIG. 2B is a schematic perspective view of an electrical plug connector 10, as described with reference to FIGS. 1 and 2A. The housing 400 is covered by a cover 200 and a secondary locking member (CPA) 100 is inserted into the housing 400 and the cover 200. In the configuration shown in FIG. 2B, the electrical plug connector 10 is in an uncoupled or incorrectly coupled condition and the secondary locking member 100 is not locked. This can be seen in that the secondary locking member 100 is protruding from the backside of the electrical plug connector 10, respectively from the backside of the cover 200. In case the plug connector is properly connected to this counterpart, the secondary locking member CPA 100 can be further inserted into the housing and will be substantially flush with the backside of the cover 200. Thus, there is a visual feedback for a correct coupling of the plug connector 10. Further, the correct coupling can be monitored electrically or electronically, as the CPA 100 will open a short-circuiting contact of the shorting clip 530 between the first and second electrical contact terminals 500*a*, 500*b*.

Figure 3:
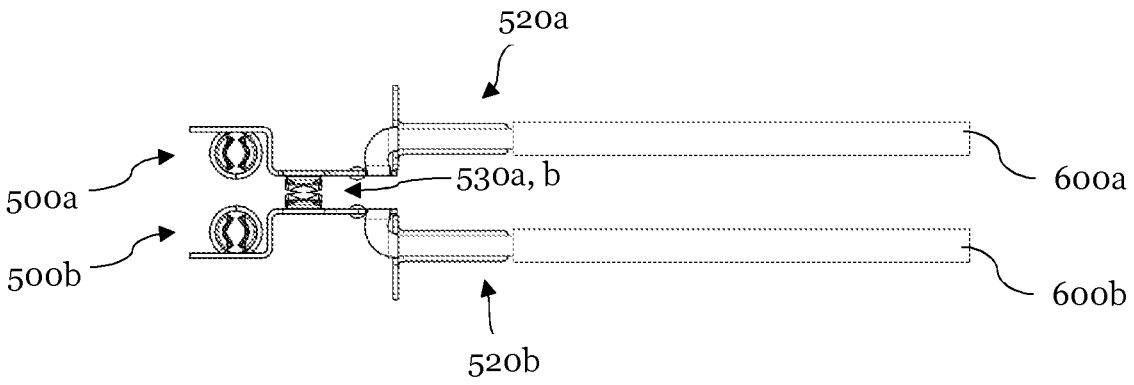
FIG. 3 shows a schematic top view (in a mating direction) of two adjacent electrical contact terminals connected to cables.

FIG. 3 shows a perspective top view (in mating direction A) of two adjacent electrical contact terminals 500*a*, 500*b*. The configuration shown in FIG. 3 corresponds to the configuration of the electrical contact terminals within the housing 400 of the plug connector 10. Here, a shorting clip portion 530*a* of the first electrical contact terminal 500*a* electrically contacts a shorting clip portion 530*b* of the electrical contact terminal 500*b* via shorting faces and thereby short-circuiting these terminals. In case the electrical plug connector 10 is correctly coupled to its counterpart, the shorting clip can be opened.

Figure 4:
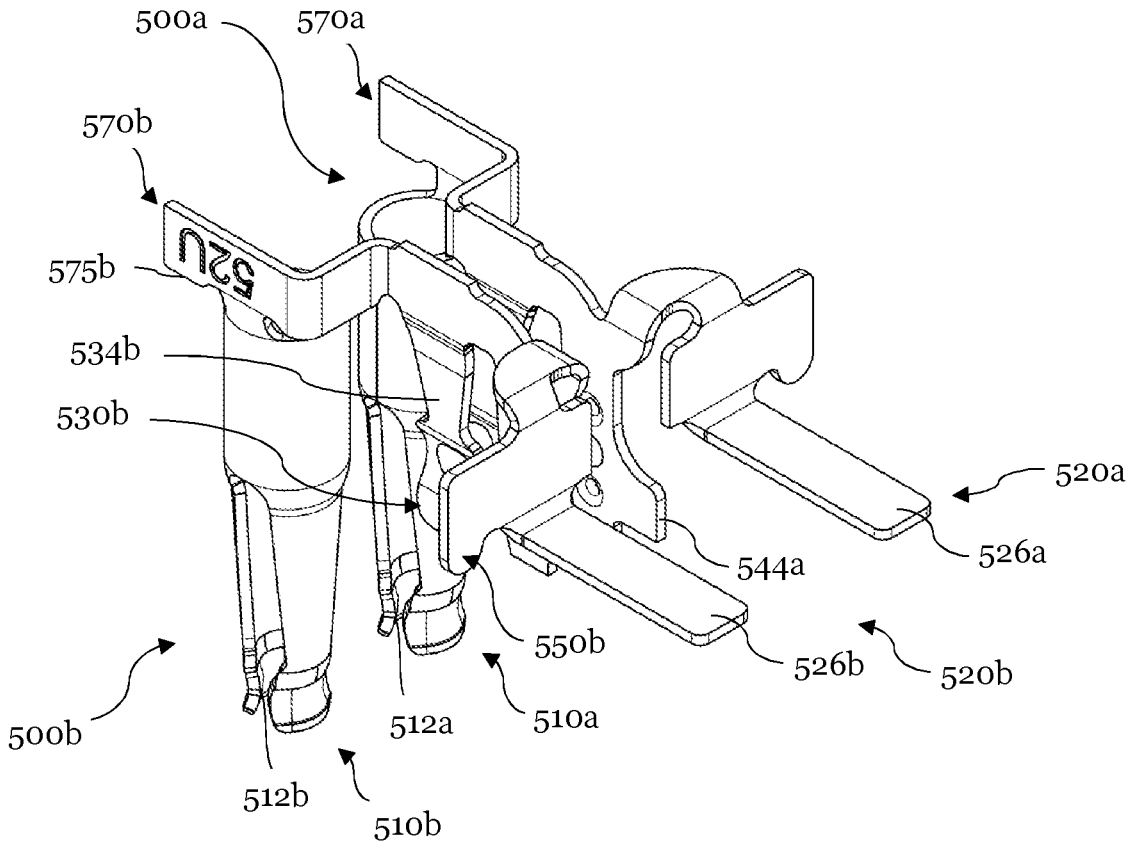
FIG. 4 shows a schematic perspective view of two adjacent electrical contact terminals.

FIG. 4 shows a schematic perspective view of two adjacent electrical contact terminals 500*a*, 500*b*. The contact terminal 500*a* is shown in greater detail in a perspective view in FIG. 5. Generally, the first electrical contact terminal 500*a* and the electrical contact terminal 500*b* are formed symmetrically. Thus, the features of an electrical contact terminal will now be described with reference to FIG. 5. All features of the electrical contact terminal 500*a* are referenced with a reference sign containing small letter "a". However, all these features are also present in the second electrical contact terminal 500*b*. Same features have the same reference sign wherein the features of the first contact terminal are marked with a small letter "a" and the features of the second electrical contact terminal 500*b* are marked with a small letter "b".

Figure 5:
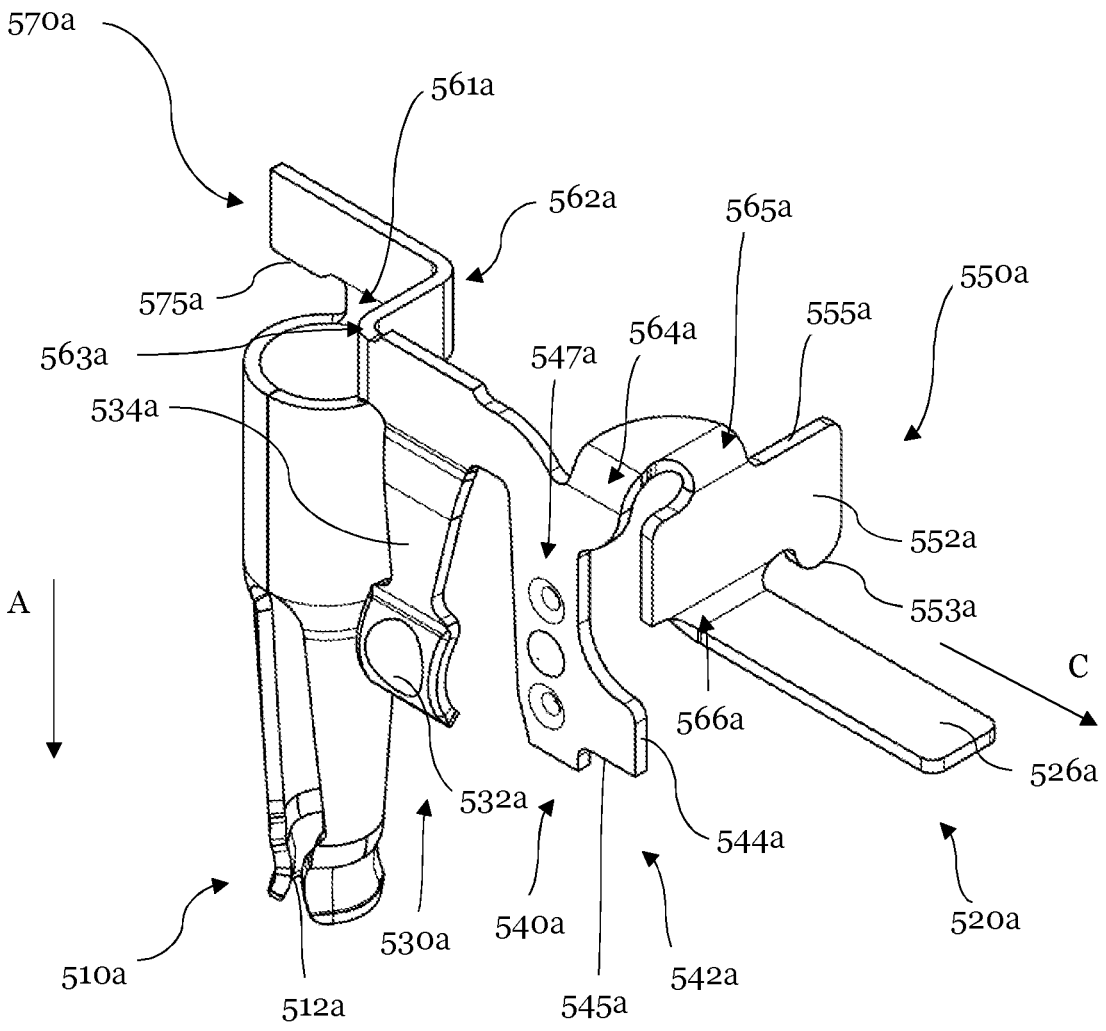
FIG. 5 shows a schematic perspective view of a single electrical contact terminal.

FIG. 5 shows a schematic prospective view of a single electrical contact terminal 500*a*. The following description is respectively valid for the second electrical contact terminal 500*b*. The electrical contact terminal 500*a* comprises a mating end 510*a* for electrically 25 contacting and receiving an electrical contact of a corresponding counter connector such as a contact pin. The mating end 510*a* comprises a contact face 512*a*, which is in electrical contact with a corresponding electrical contact pin of a corresponding counter connector, if plug connector is electrically coupled to the corresponding counter connector. The contact face 512*a* may be plated with a Ni-containing alloy and/or an Au-containing alloy to improve the conductivity of the electrical contact and to provide oxidation resistance.

The extension of the mating end defines the mating direction A of the electrical contact terminal 500*a* and therefore of the electrical plug connector. In an upper section, the mating end 510*a* has a substantially cylindrical form, wherein a first bent portion 561*a* extends laterally. The first bent portion 561*a* connects the mating end 510*a* with a bearing protrusion 570*a*. The bearing protrusion 570*a* is arranged on a bearing end of the electrical contact terminal 500*a* that is particularly opposite to the mounting end 520*a*.

The bearing protrusion 570*a* includes a second bearing face 575*a* that is a cut face of the sheet metal. A surface normal of the second bearing face 575*a* faces in mating direction A. The second bearing face 575*a* can be supported by a second contrary bearing face of the electrical plug connector, thereby defining the position of the electrical contact terminal 500*a* within the plug connector housing 400 in mating direction A (cf. FIG. 6).

The bearing protrusion 570*a* is connected via second and third bent portions 562*a*, 563*a* with a shorting clip portion 530*a* of the electrical contact terminal 500*a*. The shorting clip portion 530*a* includes a flexible arm 534*a* and a shorting face 532*a*. Further, the flexible arm 534*a* provides a contact force to close the shorting clip 530 and to maintain the shorting clip 530 in closed condition, e.g. under external forces, such as vibration.

Further, the electrical contact terminal 500*a* comprises an anchor leg 540*a* that is separate from the flexible arm 534*a*. The main plane of the anchor leg 540*a* may be arranged so as to be parallel to the mating direction A and a cable extension direction C, defined by the extension direction of the mounting end 520*a* of the electrical contact terminal 500*a*. The anchor leg 540*a* extends in mating direction A and comprises an anchor protrusion 542*a*. The anchor protrusion 542*a* extends in cable direction C.

A first abutment face 544*a* is provided at the anchor protrusion 542*a* and is a cut face of the sheet metal. The surface normal of the first abutment face 544*a* faces in cable extension direction C. Thus, a stiffness of the anchor leg 540*a* in direction of the cable extension direction C can be designed by designing the shape of the anchor leg 540*a*, as the stiffness is dependent on the second momentum of area of the anchor leg and therefore of the cut or punch design of the anchor leg 540*a*.

Further, the anchor protrusion 542*a* includes a first bearing face 545*a* that can be supported by a first contrary bearing face 445 of the plug connector housing 400 (cf. FIG. 6), thereby precisely positioning the electrical contact terminal 500*a* in mating direction A. By providing first and second bearing faces 545*a* and 575*a*, an undesired tilting of the electrical contact terminal 500*a* within the housing of the plug connector can be prevented. Further, the anchor leg 540*a* may include stiffening elements 547*a* which are provided in form of embossed elements. These embossed elements may be embossed in different sides of the anchor leg 540*a*, thereby further stiffening the anchor leg.

The electrical contact terminal 500*a* further comprises a fixing plate part 550*a* that is connected to the anchor leg 540*a* via fourth and fifth bent portions 564*a*, 565*a*. The fixing plate part 550*a* includes a second abutment face 552*a* that is formed by the main face of the sheet metal. The surface normal of the second abutment face 552*a* faces in cable extension direction C. The second abutment face is adapted to abut with a second contrary abutment face 252 of the cover 200 of the plug connector 10 and thereby increasing the allowable extension forces (cf. FIG. 9).

A mounting end 520*a* of the electrical contact terminal 500*a* is connected to the fixing plate part 550*a* via sixth bent portion 566*a*. Accordingly, the fixing plate part 550*a* is provided in close proximity to the mounting end 520*a* of the electrical contact terminal 500*a*. Thereby, a pulling force that is applied on the cable or on the mounting end 520*a* can be guided to the cover 200 and/or the housing 400 of the plug connector 10 via the second abutment face 552*a* of the fixing plate part 550*a*. Thus, the electrical contact terminal 500*a* is less prone to undesired displacement, plastic deformation and breakage.

The fixing plate part 550*a* may include a test contact portion 553*a* that can be electrically contacted e.g. monitoring the correct coupling of the electrical plug connector, as described above. Further, the fixing plate part 550*a* may comprise a gripping portion 555*a* that serves for gripping the electrical contact terminal 500*a* during an assembly process. With providing a distinct gripping portion 555*a*, no electrically functional relevant parts (such as mating end, mounting end or shorting clip portion) need to be gripped, thereby reducing the risk of negatively affecting the mounting face 526*a*, the contact face 512*a* and/or the shorting face 532*a* of the electrical contact terminal 500*a*.

Further, the electrical contact terminal 500*a* and in particular the mounting end 520*a* comprises a mounting surface 526*a* that can be plated with an Sn containing alloy. This mounting face 526*a* can be welded to a cable end 626*a* of cable 600*a* as shown in FIG. 3.

Figure 6:
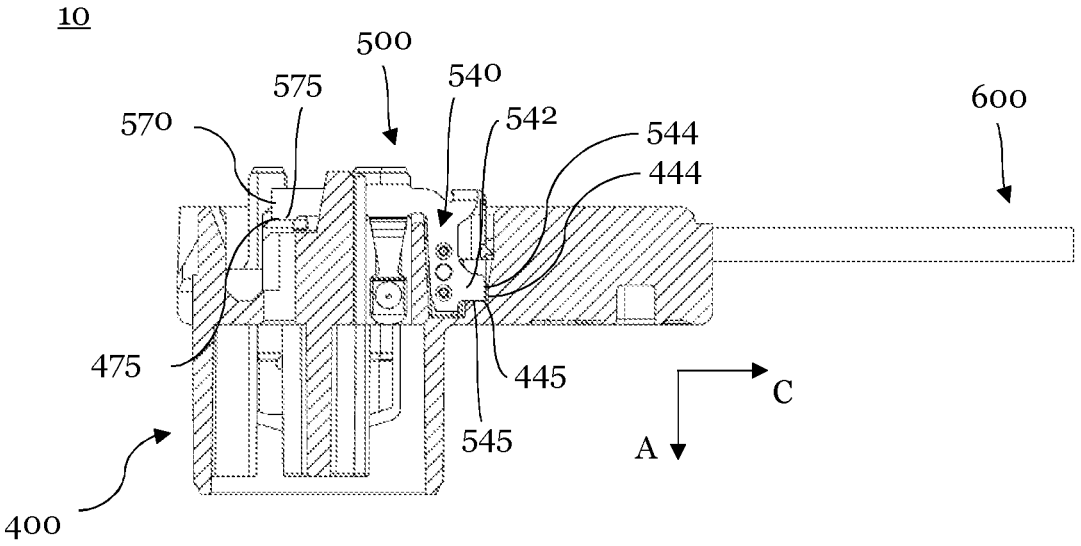
FIG. 6 shows a schematic cut view of an electrical plug connector cut through a first contrary abutment face of the housing.

In the following reference signs are used without small letters "a" or "b". Thus, the following description is valid for first and second electrical contact terminals. FIG. 6 shows a schematic cut view of an electrical plug connector 10 being cut through a first contrary abutment face 445 of the housing 400 of a plug connector 10.

As shown in FIG. 6, the first abutment face 545 of the electrical contact terminal 500 abuts the first contrary abutment face 445 of the housing 400. Thus, in case a pulling force is applied to cable 600 in cable extension direction C, the first abutment face 545 serves to guide the pulling force to the housing 400 of the plug connector 10. Accordingly, the likelihood of undesired displacement, deformation or breakage of the electrical terminal can be reduced, and the allowable retention force can be increased.

Further, the first abutment face allows an exact positioning of the electrical contact terminal 500 within the housing 400 in cable extension direction C. Further, the first bearing face 545 of the electrical contact terminal 500 is supported by the first contrary bearing face 445 of the housing 400, thereby positioning the electrical contact terminal 500 exactly in a mating direction A. On a front end of the electrical contact terminal 500 a bearing protrusion 570 is provided heaving a second bearing face 575. The second bearing face 575 is supported by a second contrary bearing face 475 of the housing 400. Thus, the electrical contact terminal is precisely positioned within the housing mating direction A and tilting of the terminal 500 can be avoided.

Figure 7:
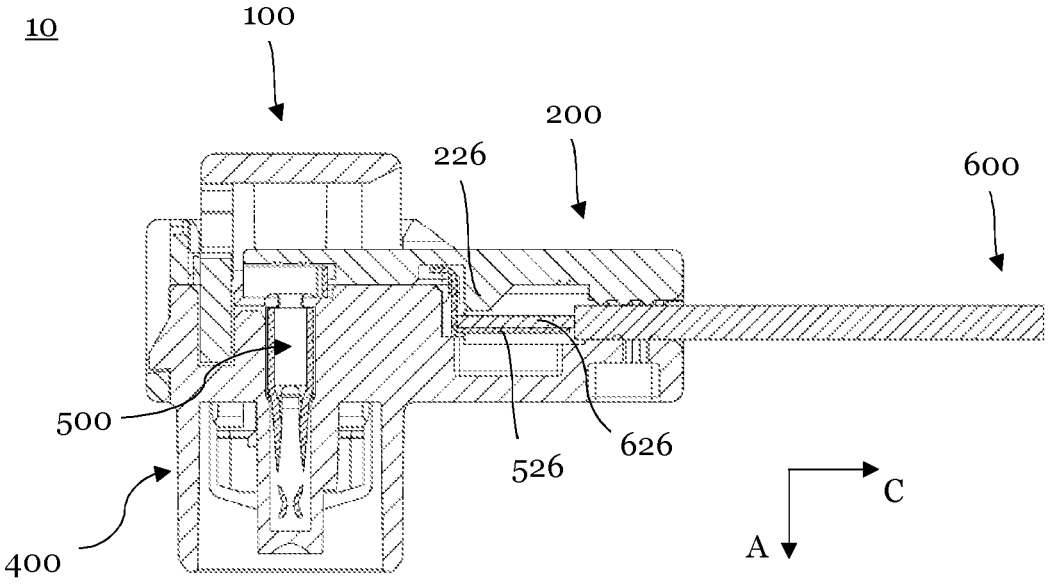
FIG. 7 shows a schematic cut view of an electrical plug connector cut through a clamping protrusion of the cover.

FIG. 7 shows a schematic cut view of an electrical plug connector 10 being cut through a clamping protrusion 226 of the cover 200. In case the cover 200 is coupled to the housing 400, the clamping protrusion 226 clamps the mounting end 520, respectively the mounting face 526 and the thereon connected cable end 626 of cable 600 with a cover 200. A pulling force applied on the cable 600 in cable extension direction C can be guided via the clamping protrusion 226 to the housing and/or the cover and thereby a displacement, a plastic deformation or breakage of the electrical contact terminal can be effectively avoided.

Figure 8:
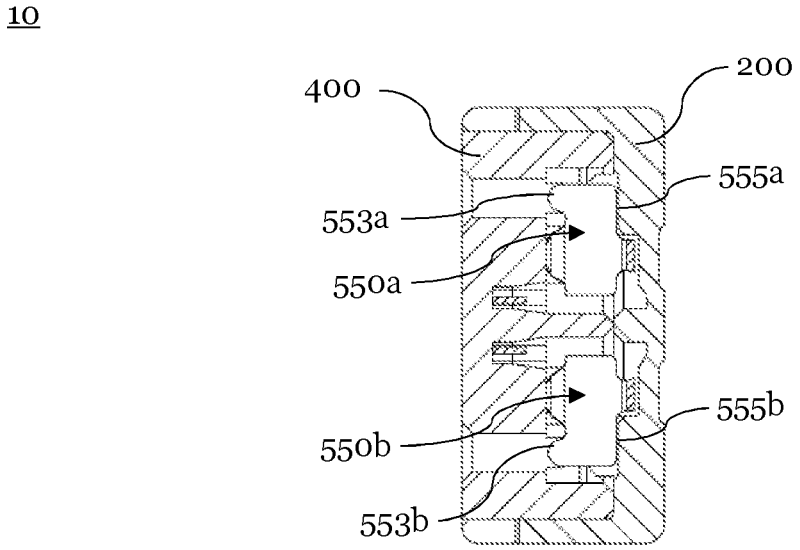
FIG. 8 shows a schematic cut view of an electrical plug connector cut through a positioning recess of the cover.

FIG. 8 shows a schematic cut view of an electrical plug connector 10 being cut through a positioning recess 250 of the cover 200. The positioning recess 250 at least partly receives the fixing plate part 550*a, b* of the respective electrical contact terminals 500*a*, 500*b*. The cover 200 may comprise a single positioning recess 250 or separate positioning recesses. The positioning recess 250 forms a second contrary abutment face 252 that abuts the second abutment face 552 of the electrical contact terminal 500, whose fixing plate part 550 is received in the positioning recess 250. Thereby, the allowable retention force can be further increased, and the likelihood of an undesired displacement, deformation or breakage of the electrical contact terminal 500 can be reduced. Further, the test contact portions 553*a* and 553*b* are accessible through respective openings in the housing 400, thereby allowing an electric or electronic monitoring of the correct coupling of the electrical plug connector.

Figure 9:
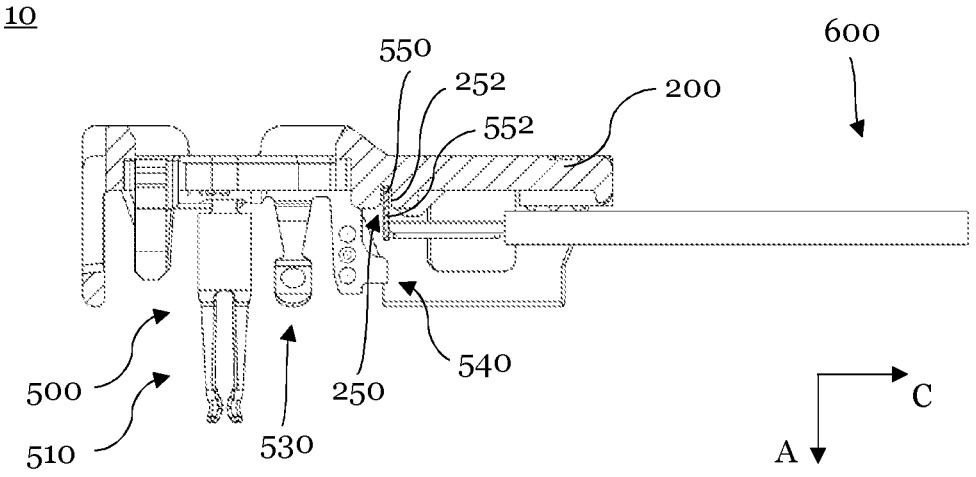
FIG. 9 shows a schematic cut view of an electrical plug connector laterally cut.

FIG. 9 shows a schematic cut view of an electrical plug connector 10, wherein the housing is not shown. As depicted in FIG. 9, the fixing plate part 550 of the electrical contact terminal 500 is received within the positioning recess 250 of the cover and the second abutment face 552 abuts the second contrary abutment face 252 of the cover 200.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An electrical contact terminal for an electrical plug connector for a safety restraint system, wherein the electrical contact terminal is made from a single piece of bent and cut sheet-metal, the electrical contact terminal comprising:

a mating end, having at least one contact face configured for electrically contacting a corresponding counter contact of a counter connector, wherein the mating end defines a mating direction of the electrical contact terminal;

a mounting end, having a mounting face configured for being electrically connected to a cable end of an electrical cable, wherein the mounting end defines a cable extension direction of the electrical contact terminal;

a shorting clip portion that is configured to short-circuit the electrical contact terminal with a further electrical contact terminal, if the electrical contact terminal is provided in the electrical plug connector and if the electrical plug connector is in uncoupled or incorrectly coupled condition;

an anchor leg extends in the mating direction to a terminal end having a first abutment face and a first bearing face that are a cut faces of the sheet metal, and wherein a surface normal of the first abutment face faces in the cable extension direction, and another surface normal of the first bearing face faces in the mating direction; and the electrical contact terminal comprises a fixing plate part, including a second abutment face that is a main face of the sheet metal, and an additional surface normal of the second abutment face faces in the cable extension direction, wherein the mounting end extends from the fixing plate part, wherein the fixing plate part is joined to the anchor leg on a side opposite the terminal end.

2. The electrical contact terminal according to claim 1, wherein the anchor leg includes an anchor protrusion extending in the cable extension direction, and the first abutment face and/or the first bearing face are provided on the anchor protrusion.

3. The electrical contact terminal according to claim 1, wherein the anchor leg comprises at least one embossed stiffening element.

4. The electrical contact terminal according to claim 1, wherein the fixing plate part includes a test contact portion.

5. The electrical contact terminal according to claim 1, comprising a bearing protrusion arranged on a bearing end of the electrical contact terminal, opposite to the mounting end, and wherein the bearing protrusion includes a second bearing face, the second bearing face is a cut face of the sheet metal, and a surface normal of the second bearing face faces in the mating direction.

6. The electrical contact terminal according to claim 1, wherein the mounting end is a welding end, and the mounting face is adapted for being welded to a cable end of an electrical cable.

7. An electrical plug connector for a safety restraint system, comprising:

a first electrical contact terminal according to claim 1;

a second electrical contact terminal according to claim 1; and a housing including a receiving portion that at least partly receives the first and second electrical contact terminals so that a shorting clip portion of the first electrical contact terminal and a shorting clip portion of the second electrical contact terminal form a shorting clip that short-circuits the electrical contact terminals, if the electrical plug connector is in an uncoupled or incorrectly coupled condition, and wherein the housing comprises at least one first contrary abutment face and/or at least one first contrary bearing face, the first contrary abutment face abuts at least the first abutment face of one of the electrical contact terminals, and the first contrary bearing face supports at least the first bearing face of one of the electrical contact terminals.

8. The electrical plug connector according to claim 7, wherein the housing further comprises at least one second contrary bearing face that supports at least the second bearing face of one of the electrical contact terminals.

9. The electrical plug connector according to claim 7, comprising a cover that is coupled to the housing and covers the receiving portion, and wherein the cover includes at least one positioning recess, the positioning recess at least partly receives the fixing plate part of one of the electrical contact terminals, and the positioning recess forms a second contrary abutment face that abuts the second abutment face of the electrical contact terminal whose fixing plate part is received in the positioning recess.

10. The electrical plug connector according to claim 9, wherein the cover includes a clamping protrusion that clamps the mounting end of the received electrical contact terminal with the housing.

11. The electrical plug connector according to claim 7, comprising a secondary locking member, which is insertable into the housing of the electrical plug connector and which upon full insertion into the housing of the plug connector separates the short-circuiting contact between the at least two shorting clip portions that form the shorting clip.

12. The electrical plug connector according claim 7, wherein the short-circuiting contact between the at least two shorting clip portions that form the shorting clip is adapted to be separated upon correct coupling of the plug connector to a corresponding counter-connector, due to a mechanical contact with a separator portion of the counter-connector.

13. A method for assembling an electrical plug connector according to claim 7, the method comprising:

inserting the electrical contact terminals in a receiving portion of the housing so that thea shorting clip portion of the first electrical contact terminal and a shorting clip portion of the second electrical contact terminal form a shorting clip that short-circuits the electrical contact terminals, if electrical plug connector is in an uncoupled or incorrectly coupled condition, and so that a first contrary abutment face of the housing abuts at least the first abutment face of one of the electrical contact terminals.

* * * * *